US005752311A

United States Patent [19]

Snyder

[11] Patent Number: 5,752,311

[45] Date of Patent: *May 19, 1998

[54] METHOD FOR EXPANDING TUBULAR MEMBERS

[75] Inventor: David A. Snyder, North Huntingdon, Pa.

[73] Assignee: Westinghouse Electric Corporation, Pittsburgh, Pa.

[ * ] Notice: The term of this patent shall not extend beyond the expiration date of Pat. No. 5,479,699.

[21] Appl. No.: 387,661

[22] Filed: Feb. 13, 1995

Related U.S. Application Data

[62] Division of Ser. No. 192,536, Feb. 7, 1994, Pat. No. 5,479,699.

[51] Int. Cl.[6] ..... B23P 15/00

[52] U.S. Cl. ..... 29/723; 29/727; 29/890.044; 29/235

[58] Field of Search ..... 29/235, 725, 727, 29/890.044, 523, 723

[56] References Cited

U.S. PATENT DOCUMENTS

| | | | |
|---|---|---|---|
| 1,530,381 | 3/1925 | Leedom . | |
| 4,195,390 | 4/1980 | Amen | 29/421 R |
| 4,513,497 | 4/1985 | Finch | 29/727 |
| 4,716,753 | 1/1988 | Martin | 29/727 |
| 4,724,595 | 2/1988 | Snyder | 29/727 |
| 4,876,871 | 10/1989 | Arzenti et al. | 72/122 |
| 4,918,808 | 4/1990 | Cartry et al. | 29/727 |
| 5,062,199 | 11/1991 | Kelly | 29/727 |
| 5,119,862 | 6/1992 | Maimets et al. | 138/98 |
| 5,167,064 | 12/1992 | Sutor, IV | 29/727 |
| 5,201,118 | 4/1993 | McParland | 29/890.031 |
| 5,301,424 | 4/1994 | Snyder | 29/890.044 |

*Primary Examiner*—Larry I. Schwartz
*Assistant Examiner*—Marc Wo Bulter

[57] ABSTRACT

Method for expanding tubular members, such as U-shaped heat transfer tubes having ends thereof located in the confined space adjacent the curved sides of the bowl-shaped lower plenum of a typical nuclear steam generator. The apparatus includes an elongate mandrel having a flow channel therethrough in communication with a resilient tubular bladder surrounding the mandrel. The bladder is flexible about its longitudinal axis due to the ribbed construction of the wall thereof. The mandrel includes a plurality of segments, adjacent ones of the segments interconnected by a ball-and-socket joint therebetween, so that the segments swivel about respective ones of the ball-and-socket joints. Thus, the mandrel and the expandable bladder connected thereto are flexible rather than rigid in order to be easily inserted into the tube ends located adjacent the curved sides of the bowl-shaped plenum and in order to easily traverse the upper U-bend portion of the tube.

6 Claims, 7 Drawing Sheets

METHOD FOR EXPANDING TUBULAR MEMBERS

This is a division of application Ser. No. 08/192,536 filed Feb. 7, 1994 now U.S. Pat. No. 5,479,699.

BACKGROUND OF THE INVENTION

This invention generally relates to tube expansion and more particularly relates to an apparatus and method for expanding tubular members, such as heat transfer tubes and repair sleeves of the kind found in typical nuclear steam generators.

A typical nuclear steam generator or heat exchanger generates steam when heat is transferred from a heated and radioactive primary fluid to a non-radioactive secondary fluid of lower temperature. The primary fluid flows through a plurality of U-shaped tubes that pass through a plurality of support plates disposed in the steam generator. The ends of the tubes are received through holes in a tubesheet, which is also disposed in the steam generator. The ends of the tubes are in communication with a bowl-shaped lower plenum located below the tubesheet, the lower plenum being divided into an inlet plenum chamber and an outlet plenum chamber. During operation of the steam generator, the secondary fluid surrounds the exterior surfaces of the tubes as the primary fluid flows from the inlet plenum chamber, through the tubes and into the outlet plenum chamber. As the heated primary fluid flows through the tubes, the walls of the tubes function as heat conductors for transferring heat from the primary fluid to the secondary fluid. As the heat is transferred from the primary fluid to the secondary fluid, a portion of the secondary fluid vaporizes to steam for generating electricity in a manner well known in the art.

Occasionally, due to tube wall intergranular cracking caused by stress and corrosion during operation, the steam generator tubes may degrade (i.e., experience tube wall thinning) and thus may not remain leak-tight. If through-wall cracking occurs due to the degradation, the radioactive primary fluid may leak through the crack and commingle with the nonradioactive secondary fluid, a highly undesirable result.

However, if degradation is suspected, the tube, although degraded, may remain in service by sleeving the degraded portion of the tube. When sleeving is performed, a tubular repair sleeve is inserted into the tube to cover the degraded portion of the tube. The sleeve is then secured to the tube by radially expanding the sleeve into intimate engagement with the inner wall of the tube, such that the degraded portion of the tube is spanned or covered. In this manner, the radioactive primary fluid is prevented from commingling with the non-radioactive secondary fluid even though the wall of the tube is degraded. Such expansion of the sleeve is usually accomplished by means of a mechanical or hydraulic expansion mandrel.

Moreover, there is usually an annular gap defined between the outer walls of the tubes and the inner walls of the holes in the tubesheet through which the ends of the tubes are received. Potentially corrosive sludges (e.g., iron oxides, copper compounds and other metals), which settle-out of the secondary fluid, can accumulate on the upper surface of the tubesheet and flow down into such annular gaps. To prevent these potentially corrosive sludges from collecting within the annular gaps, each heat transfer tube is radially expanded to close the gap defined between the outer wall of the tube and the inner wall of the hole in the tubesheet. As in the previously mentioned case of sleeving, such expansion of the heat transfer tube for purposes of gap reduction is usually performed by means of a mechanical or hydraulic expansion mandrel.

However, applicant has observed that it is difficult to perform sleeving or tube-to-tubesheet gap reduction when the end of the heat transfer tube is located adjacent the curved sides of the bowl-shaped lower plenum of the steam generator. That is, the limited space available between the ends of the heat transfer tubes and the sides of the bowl-shaped lower plenum make it difficult to insert prior art mandrels into the tube ends to perform the required tube-to-tubesheet gap reduction and sleeving. This is so because prior art expansion mandrels are straight and rigid; thus, such prior art mandrels cannot be bent to maneuver them through such a confined space for insertion into the tube ends. Hence, repair of such tubes is difficult and sometimes impossible. Therefore, a problem in the art is to provide an expansion mandrel suitable for insertion into the ends of heat transfer tubes located adjacent the periphery of the tubesheet (i.e., adjacent the sides of the bowl-shaped lower plenum of the steam generator).

Also, it is sometimes necessary to repair a portion of the tube that is located at or beyond the tightly curved upper U-bend region of the tube. Therefore, it is preferable that such an expansion mandrel be capable of traversing the upper U-bend region of the heat transfer tube. However, prior art expansion mandrels are rigid and thus cannot readily bend to traverse the upper U-bend region of the heat transfer tube. Therefore, another problem in the art is to provide an expansion mandrel capable of traversing the U-bend upper region of the heat transfer tube.

In addition, applicant has observed that prior art expansion mandrels require lubrication for easier insertion into the heat transfer tube. Such lubrication is particularly needed for inserting the mandrel into tubes located in the confined space adjacent the sides of the bowl-shaped lower plenum the steam generator. However, such lubrication increases the time for completing the repair process because the lubricants, require extensive post-cleaning operations to avoid possible chemical reaction with the tube material during operation of the steam generator. Therefore, yet another problem in the art is to provide an expansion mandrel that does not require the use of lubricants.

Moreover, applicant has further observed that prior art expansion mandrels require a relatively close tolerance fit between the mandrel and the inside diameter of the tube or sleeve to provide the appropriate amount of outwardly directed force against the inside diameter. However, such a close tolerance increases the risk of frictional wear on undegraded portions of the heat transfer tube as the mandrel is inserted into the tube and translated therein. The risk of frictional wear is greatest when attempting to maneuver the mandrel into the tubes located adjacent the periphery of the tubesheet (i.e., adjacent the sides of the bowl-shaped lower plenum of the steam generator). Therefore, another problem in the art is to provide an expansion mandrel that reduces the risk of frictional wear on the tube.

Furthermore, applicant has observed that the usefulness of prior art expansion mandrels is also limited by the amount of diametrical expansion growth and tube ovality (i.e., the amount the tube is out-of-round). That is, mandrels having O-ring/urethane seals typically possess a maximum diametrical expansion capability of only approximately 0.045 inch with little or no tolerance for tube ovality due to the close tolerances of the metal-to-urethane interfaces. If the close tolerances of the metal-to-urethane interfaces are not adhered to, then the seals will tend to extrude until failure as they are subjected to high expansion pressures. In addition, expansion of the mandrel beyond approximately 0.045 inch may cause permanent or completely plastic extrusion of the mandrel, thereby requiring replacement of the mandrel. Such permanent extrusion of the mandrel may also cause difficulty in withdrawing the mandrel from the tube without damaging the tube. The difficulty of withdrawing such a permanently extruded mandrel from the heat transfer tube is greatest with regard to tubes located adjacent the sides of the bowl-shaped lower portion of the steam generator (i.e., adjacent the periphery of the tubesheet). Therefore, yet another problem in the art is to provide a tube expansion mandrel that is sized to expand without failure and that may be inserted into and withdrawn from a tube even though the tube is out-of-round (i.e., oval).

Expansion mandrels for expanding heat transfer tubes are known. One such mandrel is disclosed by U.S. Pat. No. 4,724,595 issued Feb. 16, 1988 in the name of David A. Snyder entitled "Bladder Mandrel For Hydraulic Expansions of Tubes And Sleeves" and assigned to the assignee of the present invention. However, the Snyder mandrel is straight and rigid. Thus, this patent does not appear to disclose an expansion mandrel suitable for insertion into the heat transfer tubes located adjacent the periphery of the tubesheet. In other words, this patent does not appear to disclose an expansion mandrel that does not require the use of lubricants, that reduces the risk of frictional wear on the tube, that is capable of traversing the upper U-bend region of the heat transfer tube, and that may be inserted into and withdrawn from the tube even though the tube is out-of-round.

Therefore, what is needed are an apparatus and method for suitably expanding tubular members, such as heat transfer tubes and repair sleeves of the kind found in typical nuclear steam generators.

SUMMARY

Disclosed herein are an apparatus and method for expanding tubular members, such as U-shaped heat transfer tubes having ends thereof located in the confined space adjacent the sides of the bowl-shaped lower plenum of a typical nuclear steam generator. The apparatus includes an elongate mandrel having a flow channel therethrough in communication with a resilient tubular bladder surrounding the mandrel. The bladder is flexible about its longitudinal axis due to the ribbed construction of the wall thereof. The mandrel includes a plurality of segments, adjacent ones of the segments interconnected by a ball-and-socket joint therebetween, so that the segments swivel about respective ones of the ball-and-socket joints. In this manner, the mandrel flexes as it is inserted into the tube end located in the confined space defined by the curved sides of the bowl-shaped lower plenum of the steam generator. The mandrel also flexes as it traverses the upper U-bend portion of the tube. Thus, the mandrel and the expandable bladder connected thereto are flexible rather than rigid in order to be easily inserted into the tube ends located adjacent the curved sides of the bowl-shaped plenum and in order to easily traverse the upper U-bend portion of the tube. A pressurizer supplies pressurized fluid to the channel to controllably expand the bladder into intimate engagement with the tube in order to radially expand the tube. The mandrel is also capable of expanding repair sleeves disposed concentrically in the tube.

The invention in its broad form is an apparatus for expanding a tubular member, comprising a segmented body insertable into the tubular member and a bladder surrounding the body, the bladder capable of expanding into engagement with the tubular member for expanding the tubular member.

The invention in its broad form is also a method of expanding a tubular member, comprising the steps of inserting a segmented body into the tubular member and expanding a bladder surrounding the body into engagement with the tubular member.

An object of the present invention is to provide an apparatus and method for expanding tubular members, such as heat transfer tubes and repair sleeves of the kind found in typical nuclear steam generators.

Another object of the present invention is to provide (a) an expansion mandrel suitable for insertion into heat transfer tubes located adjacent the periphery of the tubesheet, (b) an expansion mandrel capable of traversing the upper U-bend region of the heat transfer tube, (c) an expansion mandrel that does not require the use of lubricants, (d) an expansion mandrel that reduces the risk of frictional wear on the tube, and (e) an expansion mandrel that may be inserted into and withdrawn from the tube even though the tube is out-of-round (i.e., oval).

A feature of the present invention is the provision of a mandrel insertable into the tubular member, the mandrel including a plurality of segments, adjacent ones of the segments interconnected by a ball-and-socket joint therebetween, so that the mandrel is flexible.

Another feature of the present invention is the provision of a tubular bladder surrounding the mandrel, the bladder capable of expanding into engagement with the inner diameter of the tubular member for expanding the tubular member, the bladder including a plurality of ribs extending therearound so that the bladder is flexible about its longitudinal axis.

An advantage of the present invention is that the mandrel can be easily inserted into tubes located adjacent the periphery of the tubesheet and can easily flexibly traverse the upper U-bend region of the tube.

Another advantage of the present invention is that extensive post-cleaning operations to avoid possible chemical reaction with the tube material are avoided.

Yet another advantage of the present invention is that a heat transfer tube can now be repaired without risk of causing frictional wear on the tubes.

Still another advantage of the present invention is that a heat transfer tube can be repaired even though the tube is out-of-round.

These and other objects, features, and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing out and distinctly claiming the subject matter of the invention, it is believed the invention will be better understood from the following description taken in conjunction with the accompanying drawings wherein:

DESCRIPTION OF THE PREFERRED EMBODIMENTS

Disclosed hereinbelow are an apparatus and method for expanding tubular members, such as heat transfer tubes and repair sleeves of the kind found in typical nuclear steam generators.

Figure 1:
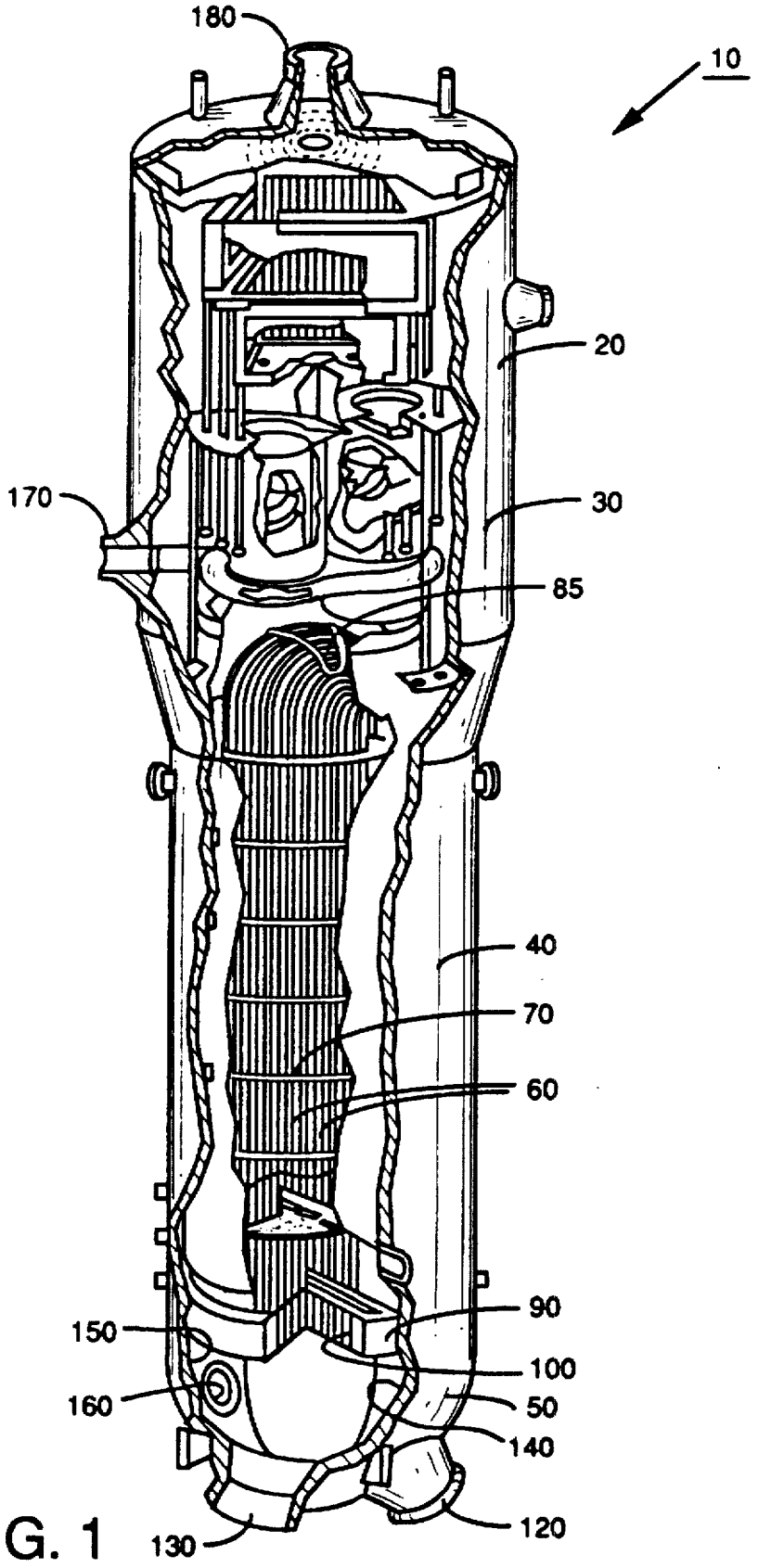
FIG. 1 is a perspective view in partial vertical section of a typical nuclear steam generator with parts removed for clarity, the steam generator having a plurality of U-shaped heat transfer tubes disposed therein, the tubes having ends thereof received through holes in a tubesheet.

Referring to FIG. 1, there is shown a typical nuclear steam generator or heat exchanger, generally referred to as 10, for generating steam. Steam generator 10 comprises a hull 20 having an upper portion 30 and a lower portion 40 that includes a generally bowl-shaped (i.e., hemispherical) portion 50. Disposed in hull 20 are a plurality of vertical U-shaped heat transfer tubes 60 that extend through a plurality of horizontal support plates 70. Each tube 60 has an inner diameter 80 (see FIG. 3), a U-bend region 85 (see FIG. 8) of relatively tight curvature or radius and a pair of tube ends 87. As shown in FIG. 1, disposed in lower portion 40 is a horizontal tubesheet 90 having holes 100 therethrough for receiving the tube ends 87. Attached to hull 20 are a first inlet nozzle 120 and a first outlet nozzle 130 in fluid communication with an inlet plenum chamber 140 and with an outlet plenum chamber 150, respectively. Inlet plenum chamber 140 and outlet plenum chamber 150 are located beneath tubesheet 90. A plurality of manway holes 160 (only one of which is shown) are formed through hull 20 below tubesheet 90 for allowing access to inlet plenum chamber 140 and outlet plenum chamber 150. Moreover, attached to hull 20 above tubesheet 90 is a second inlet nozzle 170 for entry of a non-radioactive secondary fluid (i.e., demineralized water) into hull 20. A second outlet nozzle 180 is attached to the top of upper portion 30 for exit of steam from steam generator 10.

During operation of steam generator 10, pressurized and radioactive primary fluid (i.e., demineralized water) heated by a nuclear reactor core (not shown) enters inlet plenum chamber 140 through first inlet nozzle 120 and flows through tubes 60 to outlet plenum chamber 150 where the primary fluid exits steam generator 10 through first outlet nozzle 130. As the primary fluid enters inlet plenum chamber 140, the secondary fluid simultaneously enters second inlet nozzle 170 to ultimately surround tubes 60. A portion of this secondary fluid vaporizes into steam due to the conductive heat transfer from the primary fluid to the secondary fluid. The steam rises upwardly to exit steam generator 10 through second outlet nozzle 180 and is then piped to a turbine-generator set (not shown) for generating electricity in a manner well known in the art. Moreover, the primary fluid is radioactive; therefore, for safety reasons, tubes 60 are designed to be leak-tight, so that the radioactive primary fluid does not commingle with the nonradioactive secondary fluid.

Due to tube wall intergranular stress corrosion cracking caused, for example, by corrosive attack of sludge particles settling-out from the secondary fluid, some of the tubes 60 may degrade and thus may not remain leak-tight. If a tube 60 is suspected of degradation, the degraded tube 60 may remain in service by sleeving the degraded or leaking portion (not shown) of the tube 60 with a tubular sleeve 185 concentrically disposed in tube 60. Moreover, as a prophylactic measure to prevent the initiation of stress corrosion cracking of the tube 60, particularly in the region of the tubesheet 90, the tube wall thereat may be expanded into engagement with its surrounding tubesheet 90 in order to close an annular gap 190 typically present between the tube 60 and tubesheet 90. Closing gap 190 prevents the previously mentioned sludge from accumulating in gap 190 to corrosively attack tube 60.

However, applicant has observed that it is difficult if not impossible to perform sleeving or tube-to-tubesheet gap reduction when tube 60 is adjacent the inner surface defined by the curved sides of the bowl-shaped portion 50 of the steam generator 10. Applicant has also observed that prior art rigid expansion devices cannot easily bend to traverse the relatively tight curvature of the U-bend region 85 of the heat transfer tube 60. Furthermore, applicant has observed that some tubes 60 may be out-of-round, thereby making it difficult for rigid prior art expansion devices to admit past the out-of-round portion of tube 60. These limitations of prior art expansion devices make it difficult and sometimes impossible to expand or sleeve desired portions of tube 60. Hence, it is desirable to provide a tube expansion device that can be easily inserted into tube 60, admit past any out-of-round portions of tube 60 and traverse U-bend region 85.

Figure 2:
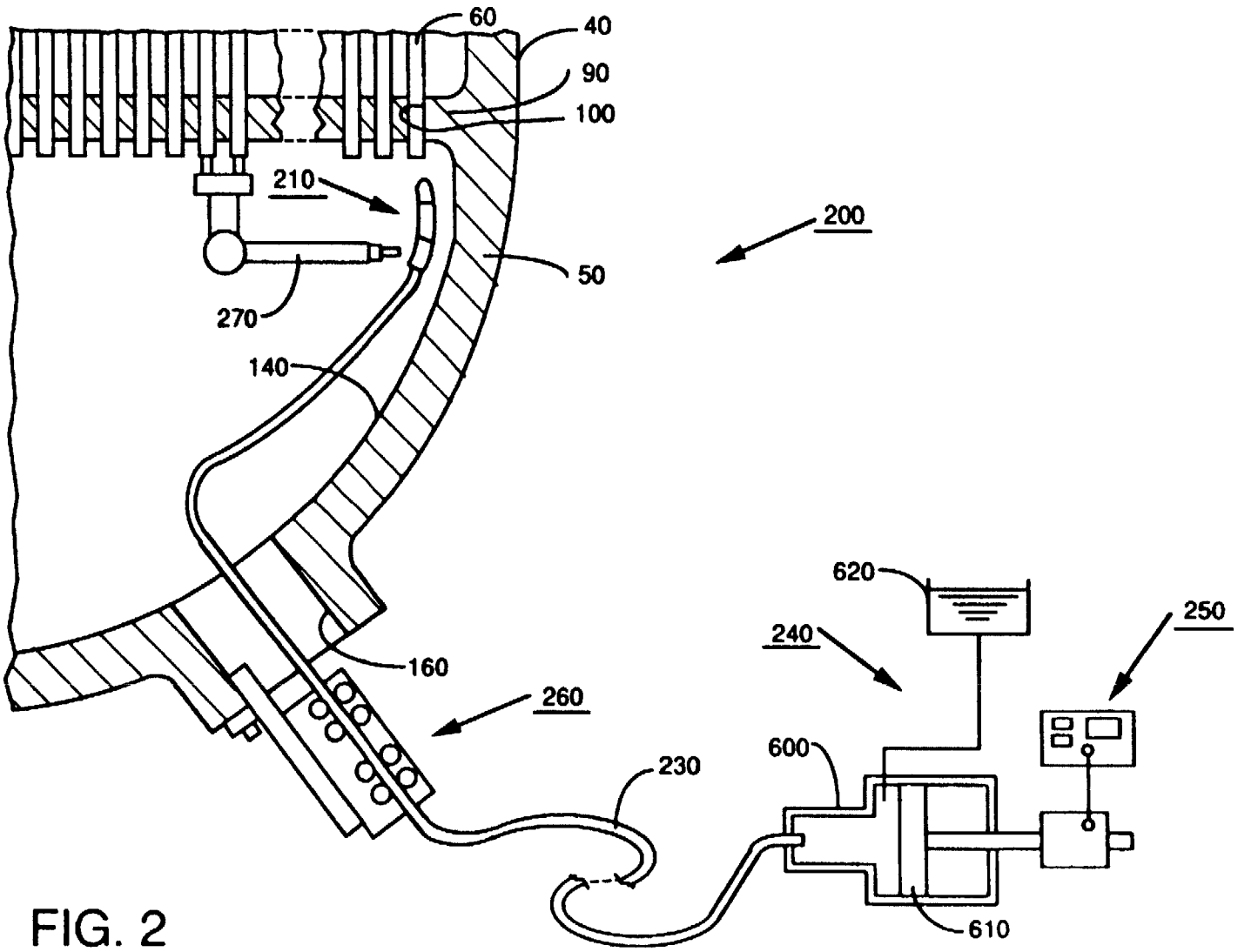
FIG. 2 illustrates the apparatus of the invention in operative condition to expand or sleeve one of the tubes located adjacent the periphery of the tubesheet.

Therefore, referring to FIG. 2, there is shown the subject matter of the present invention, which is an apparatus, generally referred to as 200, for expanding tubular members, such as heat transfer tube 60 and repair sleeve 185 of the kind found in the typical nuclear steam generator 10. Apparatus 200 comprises a segmented body or mandrel, generally referred to as 210, insertable into tube end 87 of tube 60 and having expansion means, such as expandable bladder 220, thereon for reasons described hereinbelow. Connected to mandrel 210 and in communication with bladder 220 is a flexible conduit 230 for reasons disclosed hereinbelow. Conduit 230 is connected to a pressurizer, generally referred to as 240, for supplying a pressurized fluid (e.g., air, water, oil, or the like) through conduit 230 and to mandrel 210, for radially expanding bladder 220, as disclosed in more detail hereinbelow. Control means, generally referred to as 250, is connected to pressurizer 240 for controllably operating pressurizer 240, so that pressurizer 240 controllably supplies the pressurized fluid to mandrel 210 in order to controllably pressurize bladder 220 to a predetermined pressure (i.e., approximately 14,000 to 18,000 psia). In addition, a conduit driver, generally referred to as 260, engages conduit 230 for driving or translating conduit 230 and the mandrel 210 connected thereto along the longitudinal axis of tube 60 and/or sleeve 185. Moreover, a support mechanism 270 is preferably connected to mandrel 210 for aligning mandrel 170 coaxially with tube 60 and for maneuvering mandrel 210 into tube end 87. Support mechanism is also capable of supporting conduit 230 and mandrel 210 as conduit 230 and mandrel 210 are translated in tube 60. In this regard, support mechanism 270 may be a ROSA (Remotely Operated Service Arm) robotic device available from the Westinghouse Electric Corporation located in Pittsburgh, Pa. The structure and operation of each of these major components of apparatus 200, and especially of flexible mandrel 210 and bladder 220, are described in more detail hereinbelow.

Figure 3:
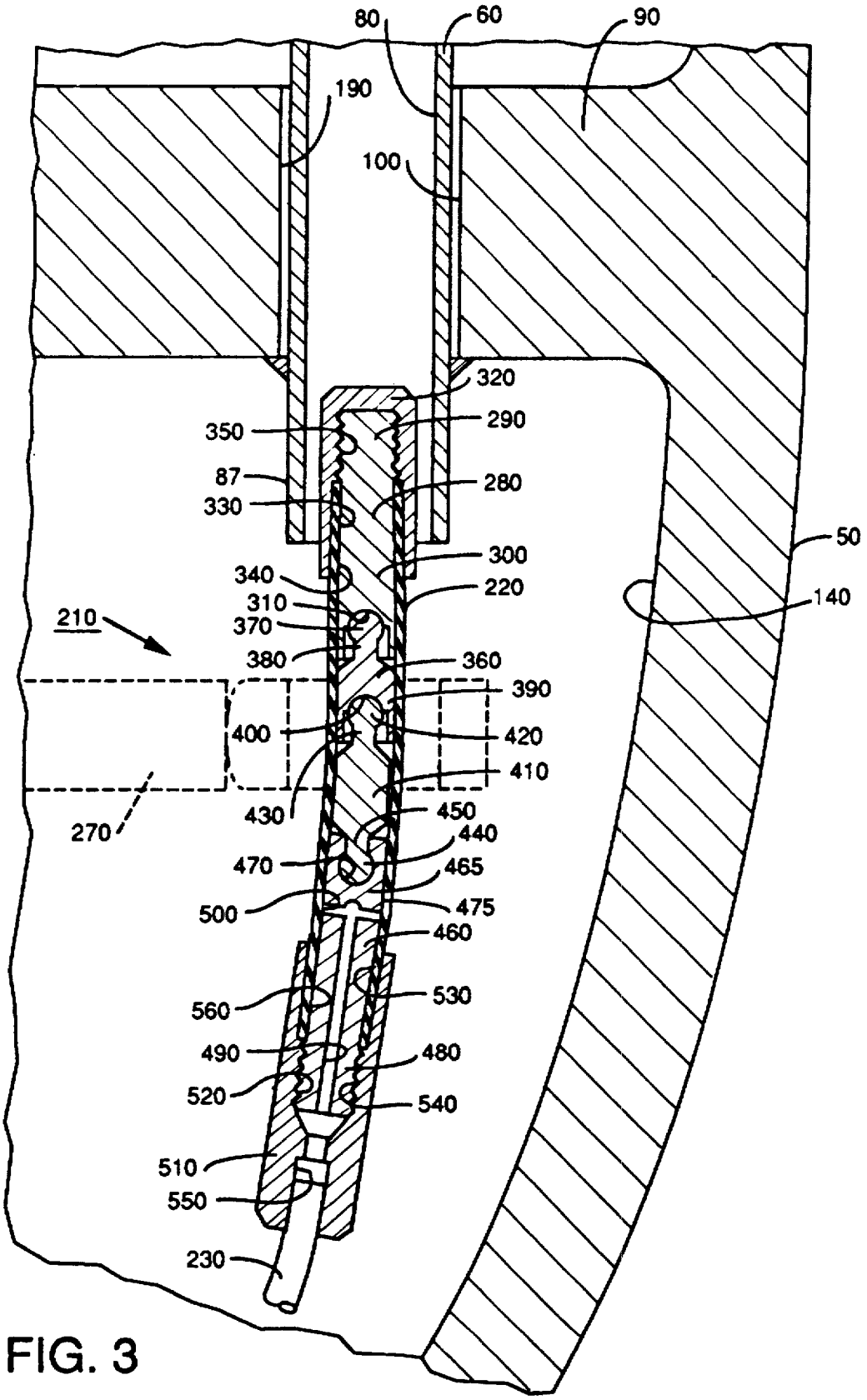
FIG. 3 shows in vertical section a flexible expansion mandrel belonging to the invention and being inserted into the tube.
Figure 4:
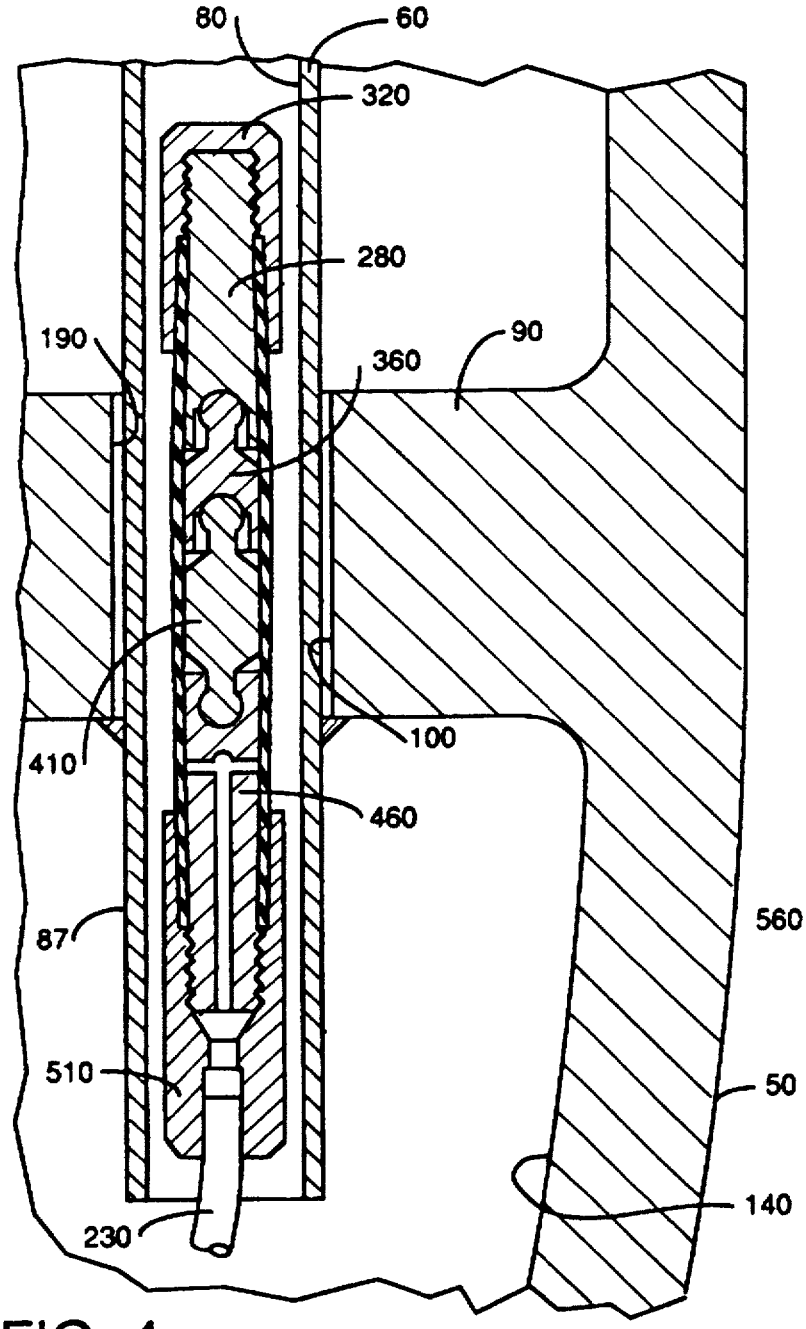
FIG. 4 is a view in vertical section of the mandrel disposed in the tube prior to expanding the tube into engagement with the surrounding tubesheet.

Turning now to FIGS. 3 and 4, flexible mandrel 210 comprises a generally cylindrical first segment 280 having an externally threaded distal end portion 290 and a proximal end portion 300. Proximal end portion 300 has a hemispherically-shaped first recess or socket 310 therein. Threadably connected to distal end portion 290 is a generally conical nose member 320 for easily inserting mandrel 210 into tube end 87. Nose member 320 has a step bore 330 defining an unthreaded portion 340 therein for reasons disclosed presently. Step bore 330 also has an internally threaded portion 350 for threadably engaging the external threads of distal end portion 290 which belongs to first segment 280. In this manner, nose member 320 is threadably connected to first segment 280.

Still referring to FIGS. 3 and 4, a generally cylindrical second segment 360, which is disposed rearward of first segment 280, includes a spherically-shaped portion or first ball 370 at a distal end portion 380 thereof. First ball 370 is sized to be matingly received in first socket 310, such that first ball 370 is capable of swivel movement as it is received in first socket 310. Second segment 360 has a proximal end portion 390 having a hemispherically-shaped second recess or socket 400 therein. A generally cylindrical third segment 410, which is disposed rearward of second segment 360, includes a spherically-shaped portion or second ball 420 at a distal end portion 430 thereof sized to be matingly received in second socket 400, such that second ball 420 is capable of swivel movement as it is received in second socket 400. Third segment 410 also includes an integral spherically-shaped portion or third ball 440 at a proximal end portion 450 thereof for reasons to become evident presently.

Referring yet again to FIGS. 3 and 4, generally cylindrical fourth segment 460 is disposed rearward of third segment 410. Fourth segment 460 has a distal end portion 465 having a hemispherically-shaped third recess or socket 470 therein that matingly receives third ball 440, such that third ball 440 is capable of swivel movement as it is received in third socket 470. In addition, fourth segment 460 has an exterior surface 475 thereon and an externally threaded proximal end portion 480 for reasons disclosed presently. For reasons provided hereinbelow, extending longitudinally through fourth segment 460 is a flow channel 490 that terminates in at least one outlet port 500 formed on exterior surface 475. Moreover, threadably connected to proximal end portion 480 of fourth segment 460 is a generally cylindrical end fitting 510. End fitting 510 has a step bore 520 defining an unthreaded portion 530 therein. Step bore 520 also has an internally threaded portion 540 for threadably engaging the external threads of distal end portion 465 which belongs to fourth segment 460. In this manner, end fitting 510 is threadably connected to fourth segment 460. Furthermore, end fitting 510 has a longitudinal bore 550 for receiving an end of conduit 230, the bore 550 being in communication with step bore 520. Of course, it will be appreciated, with reference to the several figures, that the terminology "proximal end portion" is defined herein to mean that end portion disposed nearer end fitting 510 and the terminology "distal end portion" is defined herein to mean that end portion disposed farther away from end fitting 510.

Figure 5:
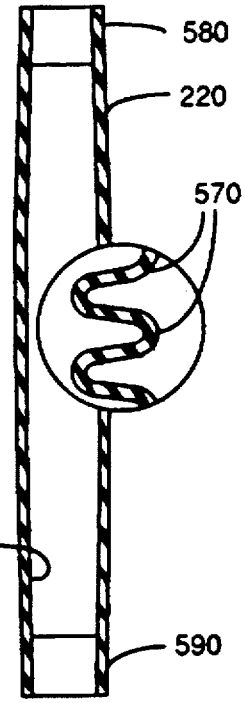
FIG. 5 is a view in vertical section of a flexible expandable bladder belonging to the mandrel.

Referring to FIGS. 3, 4, and 5, surrounding segments 280/360/410/460 is the previously mentioned bladder 220 which may be formed from a resilient thermo elastomer material, such as "PELLETHANE CPR-2103", available from the Upjohn Company, located in Torrance, Calif. Bladder 220 has an inside surface 560 that covers the previously mentioned outlet port 500. The wall of bladder 220 defines a plurality of spaced-apart circumscribing ridges or ribs 570, so that bladder 220 is flexible. In this regard, the wall of bladder 220 is defined by, in longitudinal cross section, a plurality of S-shaped ripples or rivulets that form ribs 570. A first end 580 of bladder 220 is disposed in unthreaded portion 340 of step bore 330. This first end 580 of bladder 220 is sized to be tightly sealingly interposed between first segment 280 and nose member 320. A second end 590 of bladder 220 is disposed in unthreaded portion 530 of step bore 520. This second end of bladder 220 is sized to be tightly sealingly interposed between fourth segment 460 and end fitting 510. Thus, it will be understood from the description hereinabove, that bladder 220 serves a support function as well as serving to radially expand tube 60 and/or sleeve 185. That is, bladder 220 provides the necessary structure to link or connect nose member 320 with end fitting 510 in order to maintain or hold segments 280/360/410/460 in their end-to-end configuration, as shown in the several figures.

Figure 6:
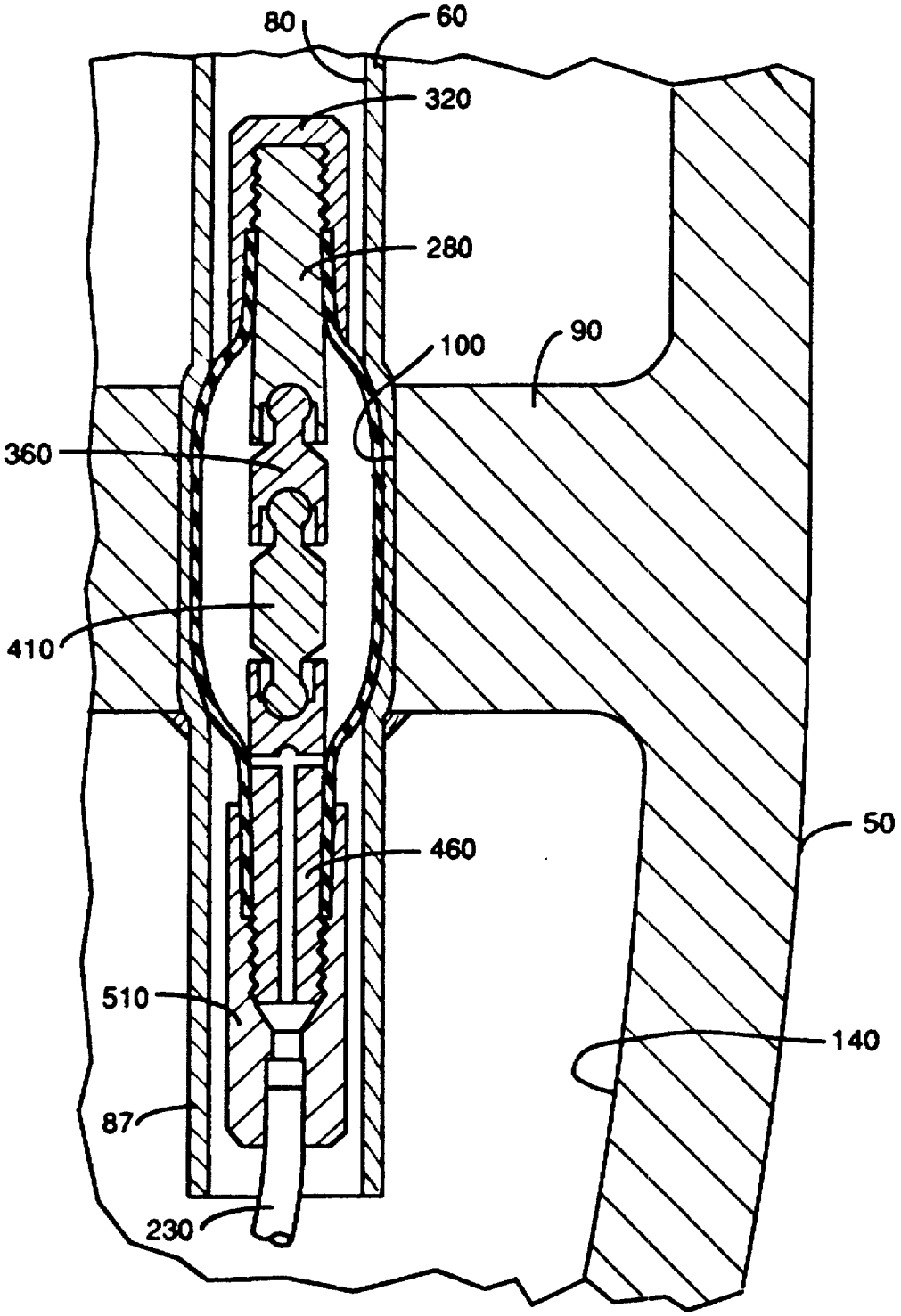
FIG. 6 is a view in vertical section of the mandrel acting to expand the tube into engagement with the surrounding tubesheet.
Figure 7:
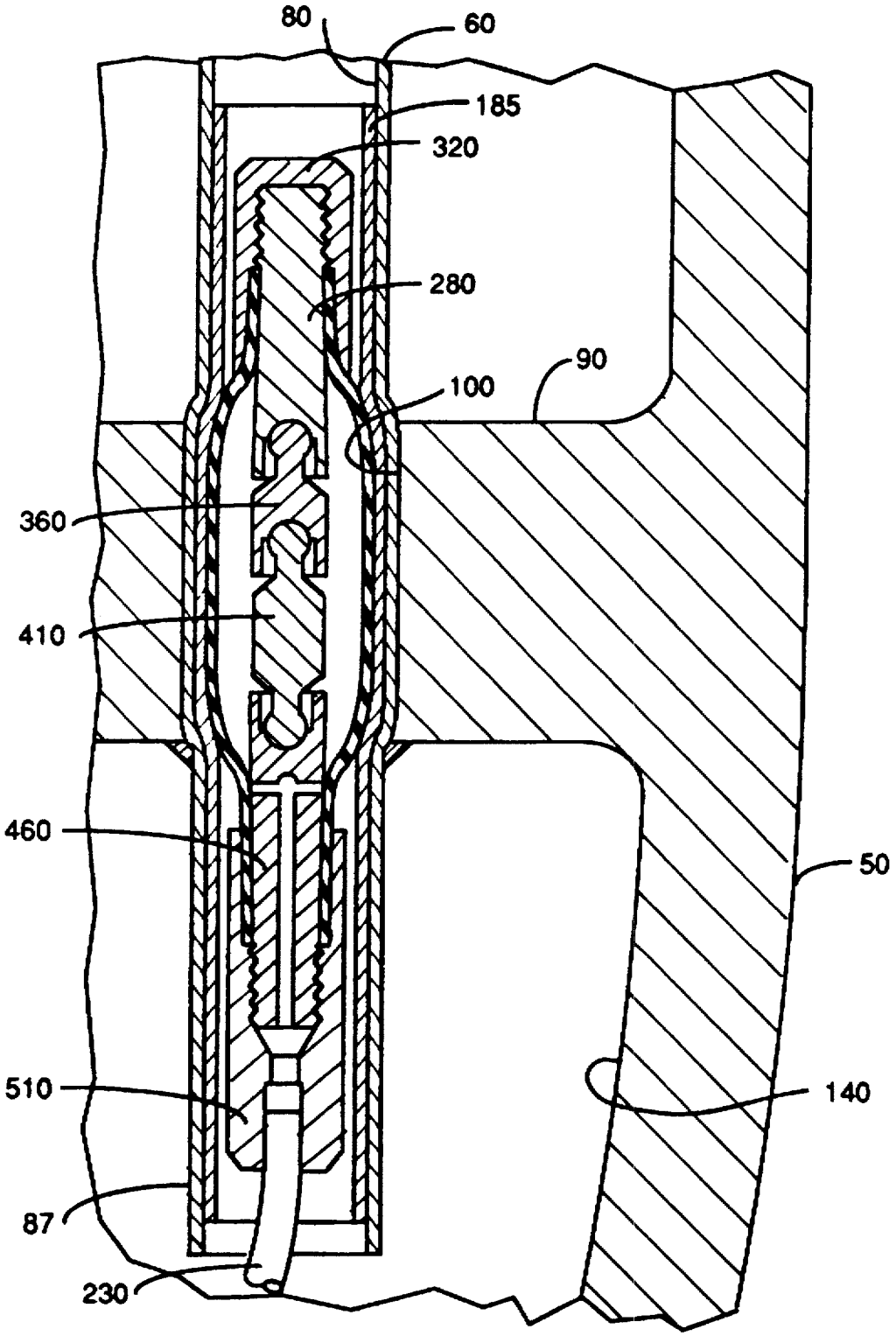
FIG. 7 is a view in vertical section of the mandrel disposed in a repair sleeve concentrically disposed in the tube, the mandrel acting to expand the sleeve into engagement with the tube for bridging a degraded portion (not shown) of the tube.

Referring to FIGS. 6 and 7, it is observed that bladder 220, which belongs to mandrel 210, is capable of hydraulically radially expanding in order to radially expand tube 60 for closing gap 190 and is also capable of hydraulically radially expanding in order to radially expand sleeve 190 for sleeving tube 60.

Figure 8:
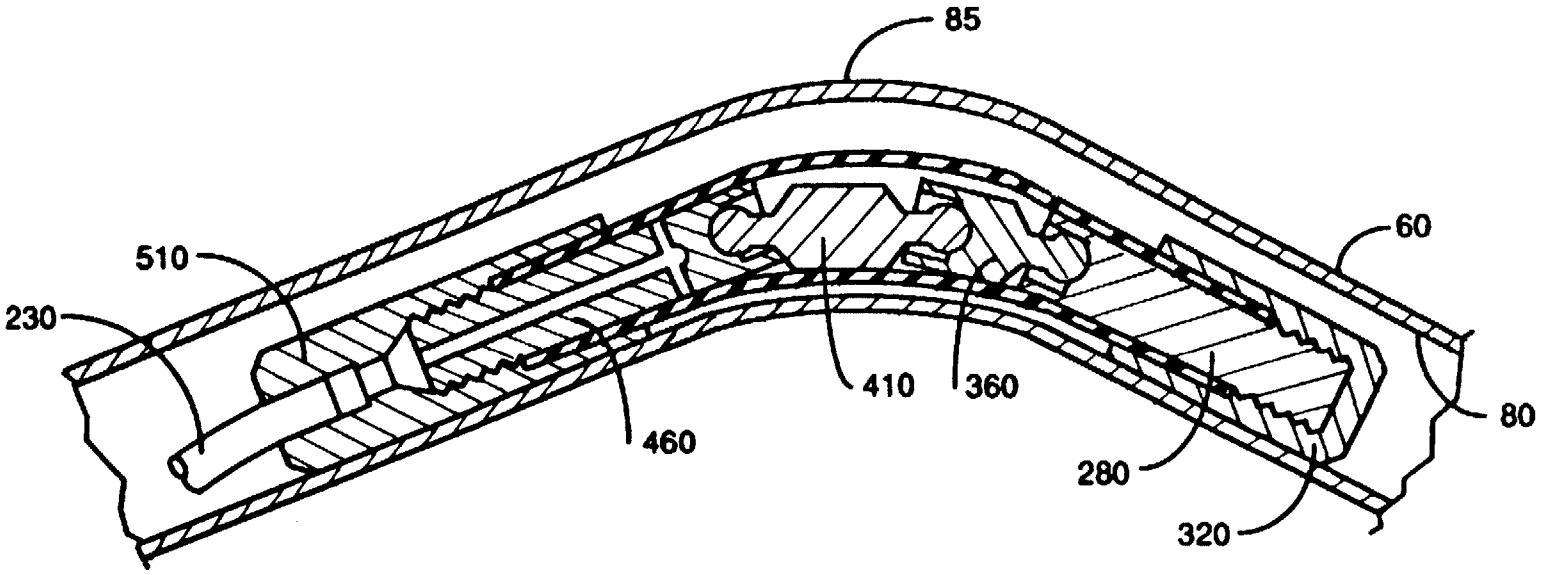
FIG. 8 is a view in vertical section of the mandrel traversing the upper U-bend region of the heat transfer tube.

As best seen in FIG. 8, mandrel 210 is also capable of navigating or traversing U-bend portion 85 of tube 60 to reach any degraded portion of tube 60. Mandrel 210 can travel through the relatively tight radius or curvature of U-bend portion 85 because segments 280/360/410/460 and bladder 220 belonging to mandrel 210 allow mandrel 210 to bend or flex.

Returning to FIG. 2, pressurizer 240 may comprise a piston arrangement 600 having at least one piston 610 therein for pressurizing the hydraulic fluid supplied by pressurizer 240 to mandrel 210. Pressurizer 240 may also include a fluid reservoir 620 in fluid communication piston arrangement 600 for providing the fluid to piston arrangement 600, which fluid is then pressurized by piston 610. Moreover, controller 250 is electrically connected to pressurizer 240 for controllably operating piston arrangement 600, which in turn controllably supplies the fluid to mandrel 210 in order to controllably pressurize and depressurize bladder 220.

OPERATION

Steam generator 10 is first removed from service in the manner customarily used in the art and apparatus 200 is transported sufficiently near steam generator 10 to perform the hydraulic expansion of tube 60 and/or sleeve 185.

In this regard, conduit driver 260 is connected to open manway 160 and support mechanism 270 is installed in inlet plenum chamber 140 (or outlet plenum chamber 150) in the usual manner.

Next, mandrel 210 is inserted through manway 160 and into inlet plenum chamber 140 (or into outlet plenum chamber 150), whereupon it is engaged by support mechanism 270 for aligning the longitudinal axis of mandrel 210 with the longitudinal axis of tube 60. However, the curved side walls of the bowl-shaped lower portion 50 of steam generator 10 may tend to interfere with or hinder the alignment of mandrel 210 with tube 60. According to the invention, this problem is overcome by the flexibility of mandrel 210. In this regard, segments 280/360/410/460 allow mandrel 210 to flex due to the swivel movement of the ball-and-socket joints 310/270, 400/420, and 470 that interconnect the segments. Moreover, ribs 570 of bladder 220 allow bladder 200 to flex or pivot about its longitudinal axis, as previously described. Consequently, segments 280/360/410/460 and ribbed bladder 220 coact in such a manner that mandrel 210 and bladder 220 flex to accommodate the curvature of bowl-shaped portion 50 of steam generator 10 as mandrel 210 is inserted through tube end 87.

Conduit driver 260 is caused to engage conduit 230 and is then operated so that mandrel 210 advances to the location of the desired tube expansion or sleeving. When mandrel reaches the desired axial position within tube 60, pressurizer 240 is operated to supply pressurized fluid (e.g., air, water, oil, or the like) into conduit 230. This fluid flows through conduit 230, through flow channel 490, through outlet port 500 and to inside surface 560 of bladder 220 in order to pressurize bladder 220 to a predetermined pressure (e.g., approximately 14,000 to 18,000 psia). As the predetermined pressure is reached in bladder 220, bladder 220 intimately engages tube 60 or sleeve 185 so that tube 60 and/or sleeve 185 radially expand. Of course, it will be understood from the description hereinabove, that as pressurizer 240 supplies the pressurized fluid to bladder 220, fluid reservoir 620 supplies make-up fluid to pressurizer 600.

Controller 250 is operated to controllably operate pressurizer 240, so that pressurizer 240 controllably supplies the pressurized fluid to bladder 220. In this manner, the predetermined pressure in bladder 220 is precisely obtained.

It will be appreciated from the description hereinabove, that an advantage of the present invention is that mandrel 210 is easily insertable into tube ends 87 adjacent the periphery of tubesheet 90 and can easily traverse the U-bend region 85 of tube 60. This is so because the mandrel 210 and bladder 220 are flexible and therefore capable of accommodating the curvature of the bowl-shaped portion 50 of the steam generator 10 and also capable of accommodating the curvature of the U-bend region 85 of tube 60. This flexibility of mandrel 210 is due to the ball-and-socket joints interconnecting the segments thereof and also due to the ribbed construction of bladder 220.

It will also be appreciated from applicant's teachings herein, that another advantage of the present invention is that extensive post-cleaning operations are avoided to prevent possible chemical reaction of any lubricants with the material comprising tube 60. This is so because lubricants, which are typically used with prior art mandrels, are not needed to facilitate insertion of mandrel 210 into tube 60. That is, mandrel 210 is flexible so that it is easily inserted into and translated along the inner diameter tube 60 without using lubricants.

It will be further appreciated from the description hereinabove, that yet another advantage of the present invention is that heat transfer tubes and sleeves can now be expanded without risk of causing frictional wear on the tube and/or sleeve. This is so because mandrel 210 is capable of flexing when being inserted into tube end 87 so that it does not scratch the inner surface of the sleeve or the tube.

Moreover, it will be appreciated from the description hereinabove, that still another advantage of the present invention is that even if tube 60 and/or sleeve 185 has an out-of-round (i.e., oval in transverse cross section) or dented diametral portion (not shown), it can nonetheless be traversed by the mandrel. That is, as mandrel 210 traverses the dented portion of tube 60 and/or sleeve 185, it will flex in such a manner that the indentation in tube 60 and/or sleeve 185 will not interfere with the axial travel of mandrel 210.

Although the invention is illustrated and described herein in its preferred embodiment, it is not intended that the invention as illustrated and described be limited to the details shown, because various modifications may be obtained with respect to the invention without departing from the spirit of the invention or the scope of equivalents thereof. For example, a suitable eddy current coil may be integrally attached to mandrel 210 for locating the elevation of tubesheet 90 prior to expanding tube 60 into engagement therewith. Such an eddy current coil may also be used to locate the degraded portion of tube 60 to be sleeved.

Therefore, what is provided are an apparatus and method for expanding tubular members, such as heat transfer tubes and repair sleeves of the kind found in typical nuclear steam generators.

What is claimed is:

1. A method of expanding a tubular member, comprising the steps of:

(a) inserting a segmented body into the tubular member, the segmented body having a flexible bladder surrounding the body, the bladder having a plurality of circumferential ribs; and (b) expanding the ribs of the bladder surrounding the body into engagement with the tubular member.

2. The method of claim 1, further comprising the step of pressurizing the bladder by operating a pressurizer in communication with the bladder for expanding the bladder.

3. The method of claim 2, further comprising the step of controlling the pressurizer by operating a controller connected to the pressurizer.

4. A method of radially expanding a tubular member having an inner diameter, comprising the steps of:

(a) inserting a flexible mandrel into the tubular member, the mandrel having an exterior surface thereon and a channel therethrough terminating in a port ion the exterior surface, the mandrel including a plurality of segments adjacent ones of the segments interconnected by a ball-and-socket joint therebetween, so that the mandrel is flexible; and (b) radially expanding a resilient bladder, including a plurality of ribs extending circumferentially therearound so that the bladder is flexible surrounding the mandrel and covering the port into intimate engagement with the inner diameter of the tubular member for radially expanding the tubular member.

5. The method of claim 4, further comprising the step of pressurizing the bladder by operating a pressurizer in communication with the channel for supplying a pressurized fluid to the channel, through the port and to the bladder for radially expanding the bladder.

6. The method of claim 5, further comprising the step of controlling the pressurizer by operating a controller connected to the pressurizer, so that the pressurizer controllably pressurizes the fluid to controllably expand the bladder.

* * * * *